United States Patent [19]

Rairden, III

[11] 4,101,714

[45] Jul. 18, 1978

[54] HIGH TEMPERATURE OXIDATION RESISTANT DISPERSION STRENGTHENED NICKEL-CHROMIUM ALLOYS

[75] Inventor: John R. Rairden, III, Niskayuna, N.Y.

[73] Assignee: General Electric Company, Schenectady, N.Y.

[21] Appl. No.: 783,187

[22] Filed: Mar. 31, 1977

[51] Int. Cl.[2] ..... B32B 15/20

[52] U.S. Cl. ..... 428/639; 428/652; 428/668; 428/680

[58] Field of Search ..... 427/405; 428/652, 680, 428/639, 640, 678, 668

[56] References Cited

U.S. PATENT DOCUMENTS

| | | | |
|---|---|---|---|
| 3,594,212 | 7/1971 | Maxwell et al. | 428/652 |
| 3,764,371 | 10/1973 | Baldi | 428/668 |
| 3,978,251 | 8/1976 | Stetson et al. | 427/405 |
| 3,979,534 | 9/1976 | Rairden | 427/253 |

*Primary Examiner*—Arthur J. Steiner

*Attorney, Agent, or Firm*—F. Wesley Turner; Joseph T. Cohen; Charles T. Watts

[57] ABSTRACT

A high temperature oxidation resistant dispersion strengthened nickel-chromium alloy body is described. The alloy body comprises a first coating of metallic cobalt and a second coating of aluminum.

8 Claims, 2 Drawing Figures

Figure 1:
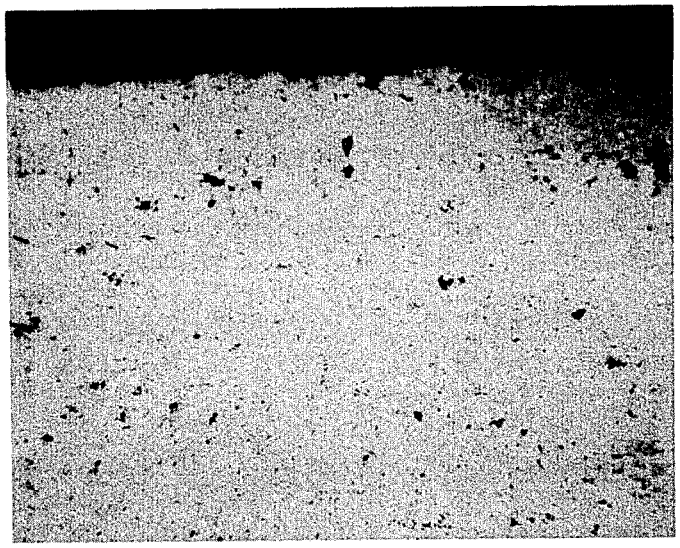

HIGH TEMPERATURE OXIDATION RESISTANT DISPERSION STRENGTHENED NICKEL-CHROMIUM ALLOYS

It is well known to strengthen metals by means of chemically inert dispersions such as oxide particles. A discussion on oxide dispersion strengthened nickel alloys is set forth by G. S. Ansell et al., *Oxide Dispersion Strengthening,* Gordon and Beach, New York, 1968. The primary interest in dispersion strengthened materials is based on their stability at very high temperatures. Dispersion strengthened nickel alloys are useful in fabrication of aircraft gas turbine engines. Other uses of dispersion strengthened nickel alloys include thermocouple sheaths, tensile-test grips, and various types of furnace hardware.

Typically, the dispersed oxide phase is added to the metal by powder metallurgy techniques. The dispersion of thoria in a nickel matrix (TD NICKEL) accomplished by a coprecipitation process was described by Anders et al., Met. Prog., 88, (Dic. 1972). The thorium oxide is suspended in a solution from which nickel hydroxide is precipitated. After drying and reduction, a fine dispersion of thorium oxide is present in a nickel matrix. This dispersion strengthening substantially increases the high temperature mechanical properties, while having no effect on the physical properties of the nickel base alloy.

A major requirement for alloys used in high temperature sections of aircraft gas turbines is resistance to surface degradation. Ever increasing temperature requirements have led to the use of oxidation resistant coatings for surface protection. It was reported by L. A. Monson et al., Technical Report, AFML-TR-66-47, Part I, March 1966, that aluminide coatings on TD NiCr and TD Ni were extremely porous. Porosity has been attributed to the unequal diffusivities of nickel and aluminum, with nickel leaving the substrate and diffusing outward faster than aluminum diffuses inward from the surface. This unequal diffusion flux results in vacancies which appear to coalesce, probably on the few larger thoria particles forming voids. Spalling of the coatings is associated with porosity at the coating-substrate interface.

It is therefore an object of the present invention to provide a dense, adherent aluminized coating on a dispersion strengthened nickel-chromium alloy.

In accordance with the present invention, I have discovered high temperature oxidation resistant dispersion strengthened nickel-chromium alloys comprising a first coating composition of cobalt and a second coating composition of aluminum. The alloys can be prepared by initially forming a first coating of cobalt on the surface of the alloy body, heat treating the body to diffuse a portion of the cobalt into the substrate and finally forming an aluminizing second coating over the first coating. The aluminized coating is characterized as being dense, nonporous and adherently bonded to the substrate.

Figure 2:
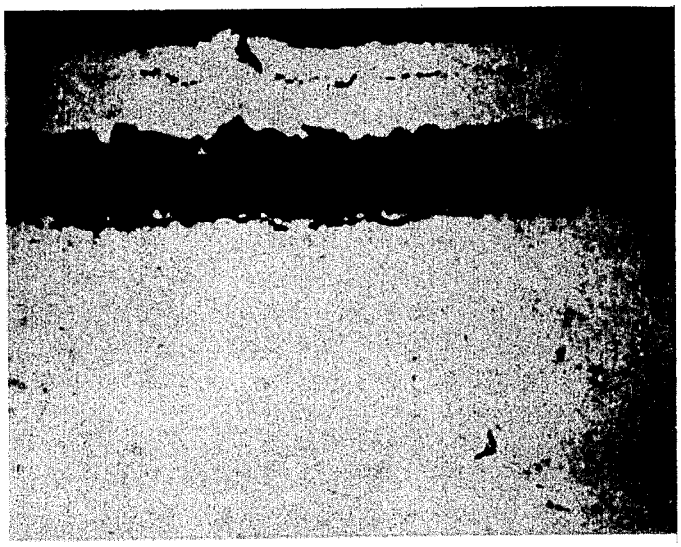

The invention is more clearly understood from the following description taken in conjunction with the accompanying drawing, in which:

FIG. 1 is a photomicrograph (500×) of a TD NiCr body pretreated with a cobalt coating and aluminized according to the method of my invention, and FIG. 2 is a photomicrograph (500×) of a TD NiCr body after aluminization without a cobalt coating pretreatment.

The dispersion strengthened substrates useful in the present invention have been described hereinabove and are further discussed in C. T. Sims et al., *The Superalloys,* John Wiley, New York, 1972, Pages 197–230. Dispersion strengthened nickel-chromium alloys experimentally or commercially available include the following:

TABLE I

| Composition | Trade Name |
|---|---|
| Ni-2 v/o $ThO_2$ | DS Nickel |
| Ni-20Cr-2 v/o $ThO_2$ | DS Nickel Chromium |
| Ni-20Cr-3Al-6Ti-6 v/o $Y_2O_3$ | MA 754 |
| Ni-15Cr-4.5Al-3Ti-3.5Mo-5.5W-2.5Ta-1.1 v/o $Y_2O_3$ | MA 755 |
| Ni-20Cr-2-3 v/o $ThO_2$ | TD NiCr |
| Ni-16Cr-4Al-2 v/o $ThO_2$ | TD NiCrAl |
| Ni-20Cr-1.5Al-2.5 Ti-2.5 v/o $Y_2O_3$ | IN 853 |
| Ni-16Cr-4Al 1 v/o $Y_2O_3$ | YD NiCrAl |
| Ni-16Cr-4Al-8 v/o $Y_2O_3$ | HDA 8077 |
| Ni-16Cr-4Al-6 v/o $Y_2O_3$ | MA 757 |
| Fe-21Cr-5Al-6 v/o $Y_2O_3$ | MA 956 |
| Co-22Ni-25Cr-5Al-1 v/o $Y_2O_3$ | YD CoNiCrAl |

In the above compositions, all the elements are in weight percent unless otherwise specified as volumn percent, abbreviated herein as *v/o.*

These oxide dispersion strengthened nickel-chromium alloys have strength properties superior to those of conventional superalloys at temperatures in excess of 1100° C. In general, the dispersion strengthened alloys contain dispersoid submicron dispersion strengthened particles, which particles generally comprise from about 0.5 to about 6 percent by volume of the alloy in the form of a dispersoid particle or particles, e.g., $Al_2O_3$, $ThO_2$, $Y_2O_3$, etc., and have an average particle size of about 300 Angstroms (0.03 micron) and an average particle size range from 50 Angstroms to about 1000 Angstroms.

The cobalt layer for oxide dispersion strengthened nickel-chromium base alloys, e.g., DS Ni, TD NiCr, YD NiCrAl, including any of the others set out in Table I or analogous alloys, must be sufficiently thick so as to provide cobalt atoms for diffusion into the substrate such that the cobalt concentration is greater than about two weight percent to at least the depth of the subsequent aluminizing overcoat. Typically, aluminizing layers extend from 1 to 3 mils into the substrate. Therefore, as a rule-of-thumb, it is preferred that the deposited layer be at least 0.1 mil thick per mil thickness of aluminized coating so that an average cobalt concentration of 10 weight percent can be achieved on the surface of the substrate by heat treatment. The cobalt coating is applied to the substrate by a physical vapor deposition technique which is described in considerable detail in *Vapor Deposition,* edited by C. F. Powell et al., John Wiley, New York (1966). Accordingly, the coating is evaporated and deposited in a vacuum chamber. Typically, the metal alloy is heated by an electron beam focused on a metal alloy ingot to evaporate the metal to a vapor. During evaporation, the vapor condenses as a coating, preferably about 0.1 to 0.3 mil in thickness on the workpiece being coated.

The cobalt-coated alloy is then subjected to a heat treatment at a temperature and for a time sufficient to cause the cobalt atoms to migrate into the substrate to the required depth for the subsequent aluminized coating. Because diffusion coefficients of cobalt in the various alloy substrates are not fully known, the proper cobalt heat treatment may typically be determined by routine experimentation.

Thereafter, the cobalt-coated body is aluminized to form a layer preferably 1.0 to 3.0 mils thick. The aluminide coating is applied to the substrate by chemical vapor deposition using a technique designated as pack cementation. This involves placing the substrate in a metal or graphite retort containing a mixture of an inert oxide filler or diluent, a halide salt, and a source of aluminum. The inert filler supports the article to be coated and the retort is usually sealed with sand or low melting glass powder. On heating, the salt decomposes and reacts with the aluminum to form a gaseous aluminum halide which serves to transfer the aluminum to the surface of the substrate alloy. A preferred type of aluminide pack cementation coating useful in the present invention is the high activity pack containing about 3–20 percent by weight of aluminum. The most practical activator is a halide salt selected from NaF, KF, $NH_4Cl$, and $NH_4F$ in an amount of about 0.1–10 percent by weight of the total pack. A representative pack contains in weight percent of about 5.8 percent Al, 0.2 percent $NH_4F$ and the balance $Al_2O_3$.

My invention is further illustrated by the following example:

A thoria dispersion strengthened nickel-chromium alloy sheet (TD NiCr Type DMM, Fansteel) 1/16 inch thick was cut into coupons about 1/5 inch × ¾ inch. These were placed in a vacuum deposition chamber and a coating of pure cobalt about 0.2 mil thick was deposited on one side of the alloy coupon. The coupon was then heat treated for 1½ hours at 1160° C in an argon atmosphere to diffuse the cobalt into the surface region of the alloy. Thereafter, the coupon was placed in an Inconel 600 retort containing an aluminizing powder pack consisting of 5.8 percent Al, 96 percent $Al_2O_3$ and 0.2 percent $NH_4F$. The aluminizing process used was three hours at 1160° C in a slowly flowing pure argon atmosphere.

After aluminizing, the sample was cross-sectioned and metallorgraphically examined. FIG. 1 shows the aluminized coating on the cobalt pretreated surface as prepared by the described process. It was observed that the aluminized coating obtained was dense, nonporous and adhered satisfactorily to the substrate.

However, a sample was prepared in which the cobalt pretreatment was omitted. The results are shown in FIG. 2. It was observed that there was a lack of bonding between the coating and the sample which was not pretreated with cobalt.

I claim:

1. An article of manufacture comprising a high temperature oxidation resistant dispersion strengthened nickelchromium alloy body comprising:
   (a) said nickel-chromium alloy body;
   (b) a first coating of cobalt having at least a portion thereof diffused therein, and
   (c) an overcoating of aluminum, said second coating being substantially nonporous and adherent to the cobalt-coated nickel-chromium alloy body.

2. The claim 1 article wherein the first coating thickness is about 0.1 to 0.3 mil, and the second coating is a thickness of about 1.0 to 3.0 mils.

3. The claim 2 article wherein said alloy consists essentially of about 20 percent by weight of chromium, the balance nickel, and 2–3 percent by volume thoria dispersed therein.

4. The claim 2 article wherein said alloy consists essentially of about 16 percent by weight of chromium, 4 percent by weight of aluminum, the balance nickel and about 2 percent by volume of thoria dispersed therein.

5. The claim 2 article wherein said alloy consists essentially of about 20 percent by weight of chromium, 1.5 percent by weight of aluminum, 2.5 percent by weight of titanium, the balance nickel, and about 2.5 percent by volume of yttria dispersed therein.

6. The claim 3 article wherein said alloy consists essentially of about 20 percent by weight of chromium, the balance nickel and about 2.5 percent by volume of thoria dispersed therein.

7. The claim 2 article wherein said alloy consists essentially of about 20 percent by weight of chromium, 3 percent by weight of aluminum, 6 percent by weight of titanium, the balance nickel and 6 percent by volume of yttria dispersed therein.

8. The claim 2 article wherein said alloy consists essentially of about 15 percent by weight of chromium, 4.5 percent by weight of aluminum, 3 percent by weight of titanium, 3.5 percent by weight of molybdenum, 5.5 percent by weight of tungsten, 2.5 percent by weight of tantalum, the balance nickel and 1.1 percent by volume of yttria.

* * * * *